US007854650B2

(12) United States Patent
Tsai

(10) Patent No.: US 7,854,650 B2
(45) Date of Patent: Dec. 21, 2010

(54) KNIFE SHARPENER

(75) Inventor: Hung-Nung Tsai, No. 181, Taiping Rd., Taiping city, Taichung County 411 (TW)

(73) Assignees: Kun-Lin Chuang, Taichung County (TW); Hung-Nung Tsai, Taichung County (TW)

( * ) Notice: Subject to any disclaimer, the term of this patent is extended or adjusted under 35 U.S.C. 154(b) by 707 days.

(21) Appl. No.: 11/626,844

(22) Filed: Jan. 24, 2007

(65) Prior Publication Data

US 2008/0176496 A1 Jul. 24, 2008

(51) Int. Cl.
*B24B 19/00* (2006.01)

(52) U.S. Cl. ..... 451/420; 451/261; 451/262; 451/267; 451/293; 451/321

(58) Field of Classification Search ..... 451/45, 451/293, 261, 262, 267, 321, 192, 193, 241, 451/234, 420

See application file for complete search history.

(56) References Cited

U.S. PATENT DOCUMENTS 2,958,987 A * 11/1960 Jepson ..... 451/267
6,267,652 B1 * 7/2001 Friel et al. ..... 451/177
6,435,951 B1 * 8/2002 Ishizaka ..... 451/66
6,802,763 B1 * 10/2004 Leung ..... 451/267
7,198,558 B2 * 4/2007 Levsen ..... 451/263
2003/0077990 A1 * 4/2003 Li ..... 451/293
2004/0116055 A1 * 6/2004 Friel ..... 451/293
2006/0286909 A1 * 12/2006 Liao ..... 451/349

* cited by examiner

*Primary Examiner*—Robert Scruggs
(74) *Attorney, Agent, or Firm*—Banger Shia

(57) ABSTRACT

A knife sharpener comprises a base, a motor, a grinding wheel assembly, a rotary shaft and a spring. The working channel between the edge of the grinding disc and the grinding awl is automatically adjustable to accommodate different blade of different thickness. When the knife sharpener performs grinding operation, the grinding wheel assembly can simultaneously grind both cutting sides of the knife. In addition, the knife can be clamped firmly through the three contacting points of the grinding disc, the grinding awl, and the cutting edge, so that the operation of knife grinding can be successfully performed.

5 Claims, 11 Drawing Sheets

KNIFE SHARPENER

BACKGROUND OF THE INVENTION

1. Field of the Invention

The present invention relates to a knife sharpener, and more particularly to a knife sharpener, wherein a high-speed running grinding wheel assembly is driven by motor power to perform grinding operation.

2. Description of the Prior Art

There are various types of knife sharpeners, which mainly include manual knife sharpener and power driven knife sharpener. What is to be discussed in the present invention is a power driven grinding wheel assembly for grinding knife. Referring to FIG. 1, a conventional electric knife sharpener with a single grinding wheel is shown and comprises a disc-shaped grinding wheel 11 disposed in a body 10, and on each side of the grinding wheel 11 is formed a slantwise opening 12 for receiving a knife 13. A user can hold the knife 13 and move it to and from in a longitudinal direction to grind the both sides of cutting edge by the both sides of the grinding wheel 11.

When using the conventional knife sharpener to perform grinding operation, the grinding wheel cannot simultaneously grind the both sides of a knife. It can only grind one side at a time. This grinding manner would render the end of cutting edge to curve toward another end for the cutting edge is pushed by the power of the grinding wheel, so that the after-grinding knife is not likely to be sharp. Therefore, when performing grinding, the user has to alternately grind each side of the cutting edge, so as to avoid one side of the cutting edge from being overly grinding.

Therefore, when performing grinding, if the two sides of the cutting edge can be ground at the same time, it not only can solve the deformation of one side of the cutting edge caused by conventional grinding manner, but also can improve the efficiency of grinding and relieve from the fussy operation.

The present invention has arisen to mitigate and/or obviate the afore-described disadvantages.

SUMMARY OF THE INVENTION

The primary objective of the present invention is to provide a knife sharpener, particularly to a knife sharpener, wherein a high-speed running grinding wheel assembly is driven by motor power to perform grinding operation. The grinding surface of a grinding disc contacts one side of the cutting edge of a knife at two contacting points to perform grinding operation, meanwhile, the tapered grinding surface of a grinding awl contacts the other side of the cutting edge of the knife at one contacting point to perform grinding operation. By such a manner, the grinding disc and the grinding awl can prevent the knife from excessively shaking and improve the stability of the operation.

The secondary objective is to provide a knife sharpener, when the knife is placed in the working channel between the edge of the grinding disc and the grinding awl, the cutting edge can push the grinding disc slightly outward to enlarge the space between the grinding disc and the grinding awl, a thin cutting edge makes a narrow space, and a thick cutting edge makes a wide space. In addition, the awl of the tapered grinding surface of the grinding awl can keep the cutting edge from overly moving downwards. In other words, the space of the working channel can cooperate with the awl of the tapered grinding surface to deal with cutting edge with different thickness, so that when cutting edge of knives with different thickness is to be ground, it can properly contact the grinding disc and the grinding awl.

DETAILED DESCRIPTION OF THE PREFERRED EMBODIMENTS

Figure 1:
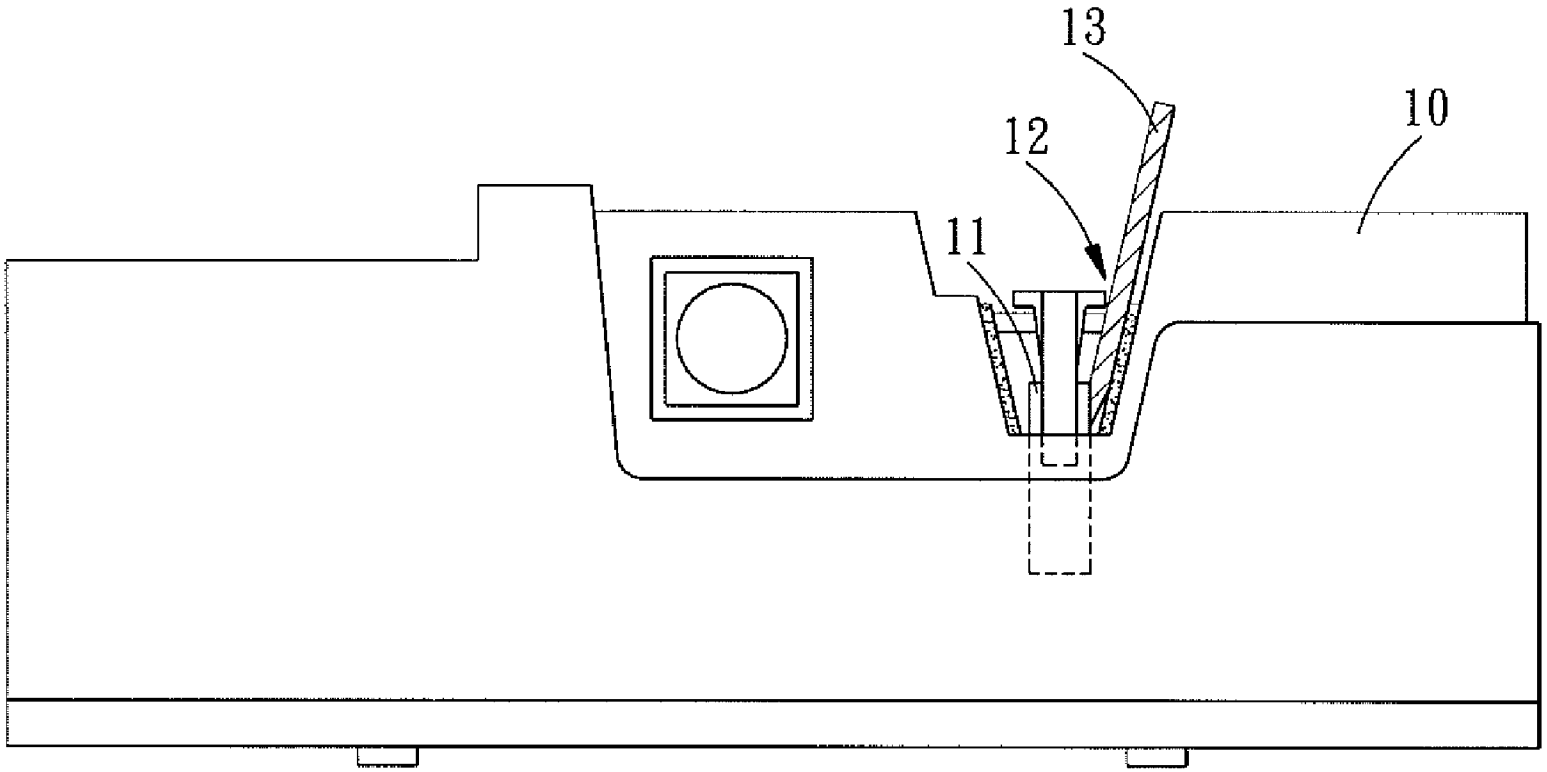
FIG. 1 PRIOR ART
FIG. 1 is a perspective view of a conventional electric knife sharpener with a single grinding wheel.
Figure 2:
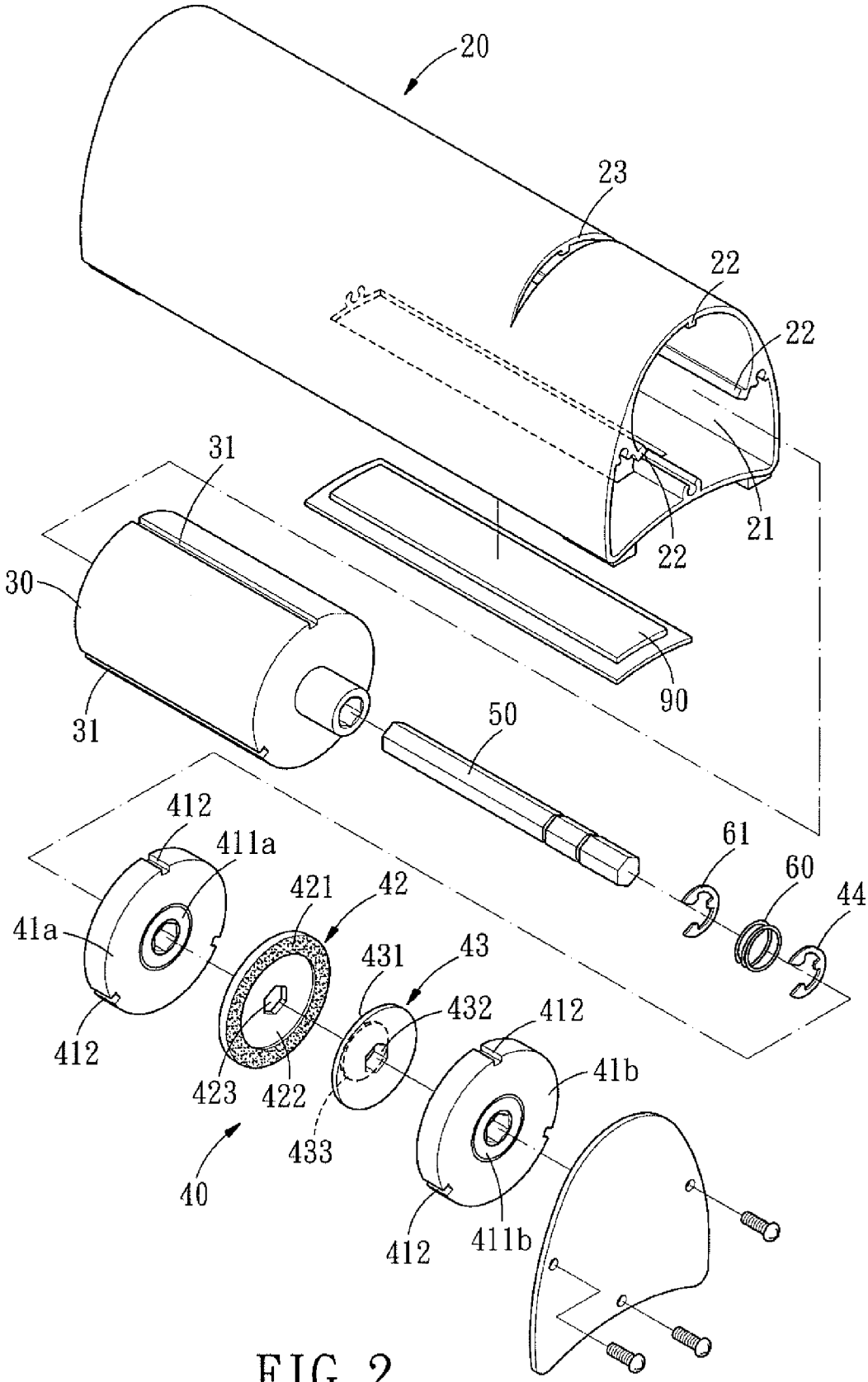
FIG. 2 is an exploded view of a knife sharpener in accordance with the present invention.
Figure 3:
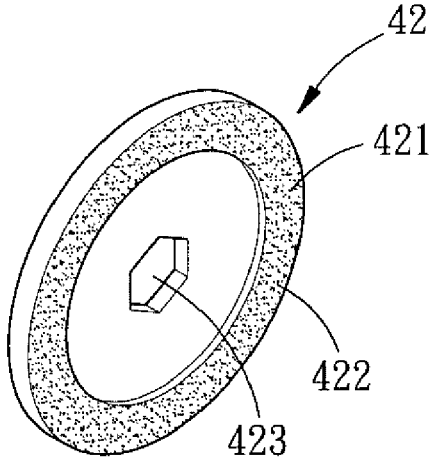
FIG. 3 is an amplified view of the grinding wheel in accordance with the present invention.
Figure 4:
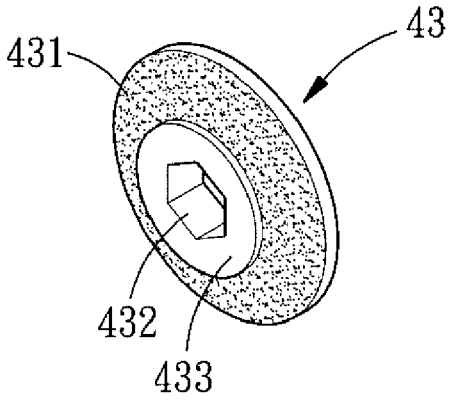
FIG. 4 is an amplified view of the grinding awl in accordance with the present invention.
Figure 5:
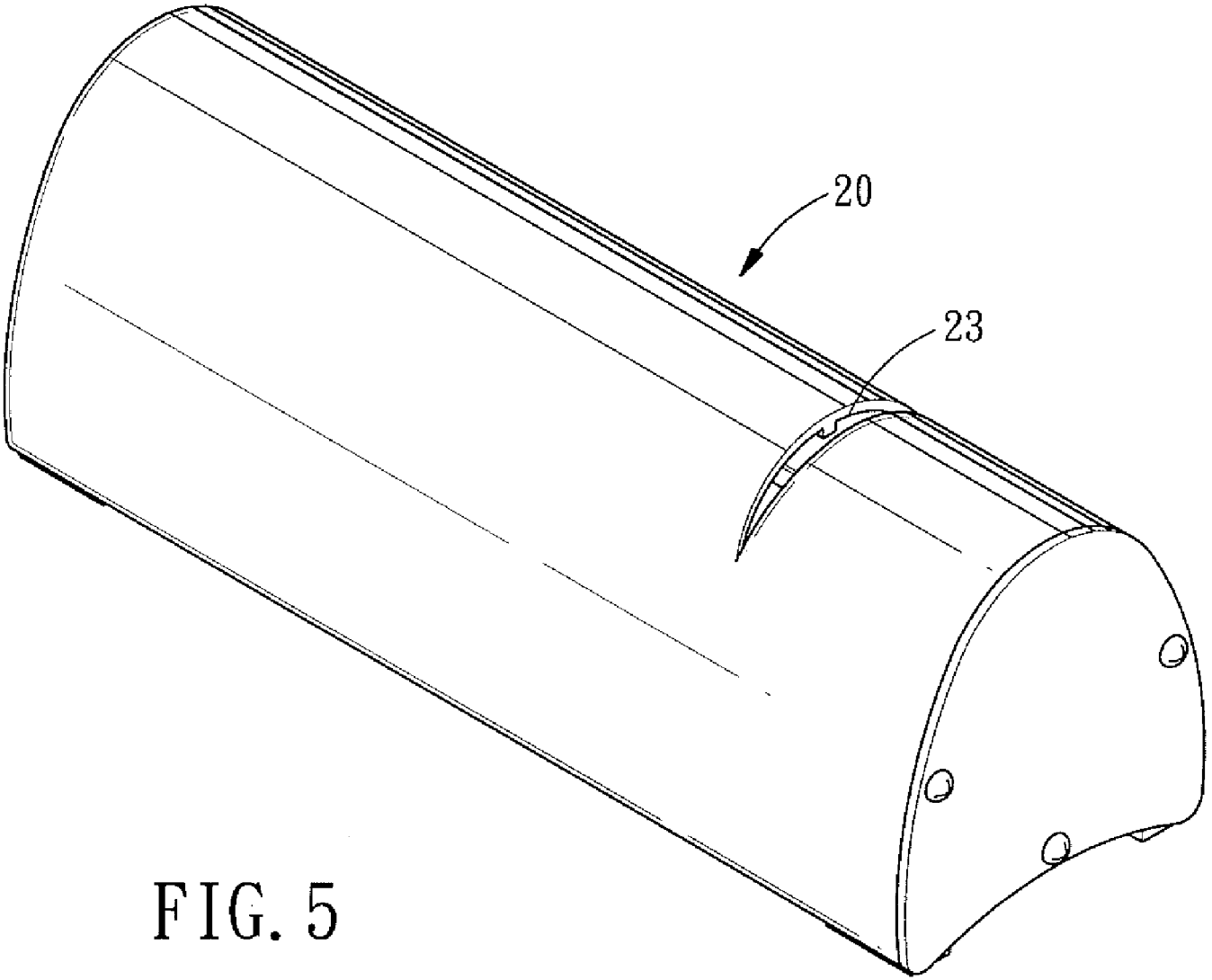
FIG. 5 is an assembly view of the knife sharpener in accordance with the present invention.

The present invention will be more clear from the following description when viewed together with the accompanying drawings, which show, for purpose of illustrations only, the preferred embodiment in accordance with the present invention.

Referring to FIGS. 2-9, a knife sharpener in accordance with a preferred embodiment of the present invention comprises a base, a motor, a grinding wheel assembly, a rotary shaft and a spring.

The base 20 is defined with a receiving space 21 for installation of the grinding assembly. Three restricting ribs 22 for fixing the grinding assembly are distantly formed in the inner surface of the receiving space 21. A plurality of slots 23 connecting with the receiving space 21 is defined in the top of the base 20, and each slot 23 is wide in the middle section and narrows toward both ends thereof.

The motor 30 is a power source of the knife sharpener. In the outer surface of the housing of the motor 30 are defined three engaging grooves 31 to mate with the restricting ribs 22 in the inner surface of the base 20, so that the motor 30 can be stably fixed at one side of the receiving space 21.

The grinding wheel assembly 40 includes two assembling members 41*a*, 41*b*, a grinding disc 42 and a grinding awl 43. Each assembling member 41*a*, 41*b*, is mounted a bearing 411*a*, 411*b*, and three engaging grooves 412 are formed in the fringe of each assembling member 41*a*, 41*b*, to mate with the restricting ribs 22 in the receiving space 21. The two assembling members 41*a*, 41*b*, are distantly assembled to render the grinding disc 42 assembled between them. The grinding disc has two surfaces, one of which is a grinding surface 421 for grinding cutting edge. In the inner side of the grinding surface 421 is defined a receiving concave 422, and a through hole 423 is formed in the middle of the grinding disc 42. The grinding awl 43 is located between the two assembling members 41*a*, 41*b* in such a manner that one surface abuts against the grinding surface 421 of the grinding disc 42, another surface is rested against a fixing member 44. The surface of the grinding awl 43 facing the grinding surface 421 is a tapered grinding surface 431, which is another grinding surface. A through hole 432 is formed in the middle of the grinding awl 43. Under normal conditions, the awl 433 of the grinding awl 43 rests against the receiving concave 422 of the grinding disc 42, while the grinding disc 42 and the edge of the grinding awl 43 are located in a certain distance away from each other to form a working channel 45, which is to be aligned with the slot 23 for allowing the knife to be inserted into the working channel through the slot 23.

The rotary shaft 50 has one end fixed to a rotor of the motor 30, so that it can be driven by the motor. Another end of the rotary shaft 50 in turn passes through the bearing of the assembling member 41*a*, the through hole 432 of the grinding awl 43, the through hole 423 of the grinding disc 42 and the bearing of another assembling member 41*b*, so that the two bearings and the grinding awl 43 are fixed on the rotary shaft 50. The rotary shaft 50 is hexagonal-shaped, and the through hole 423 of the grinding disc is a hexagonal hole accordingly, so that the rotary shaft is able to rotate the grinding disc 42 and the grinding awl 43 to grind the knife.

The spring 60 is biased between the grinding disc 42 and another fixing member 61, so as to keep the grinding surface 421 of the grinding disc 42 and the tapered grinding surface 431 of the grinding awl 43 close to each other under normal conditions. When the cutting edge 71 of a knife 70 is grinding in the working channel 45, the cutting edge 71 can move the grinding disc to make the grinding surface 421 and the tapered grinding surface 431 move slightly in horizontal direction, while the awl of the tapered grinding surface 431 can keep the cutting edge 71 from overly moving downwards, so that the grinding surface 421 and the tapered grinding surface 431 can properly contact the cutting edge 71, and the working channel 45 is accordingly adjusted to the appropriate width corresponding to the thickness of the cutting edge 71.

Figure 7:
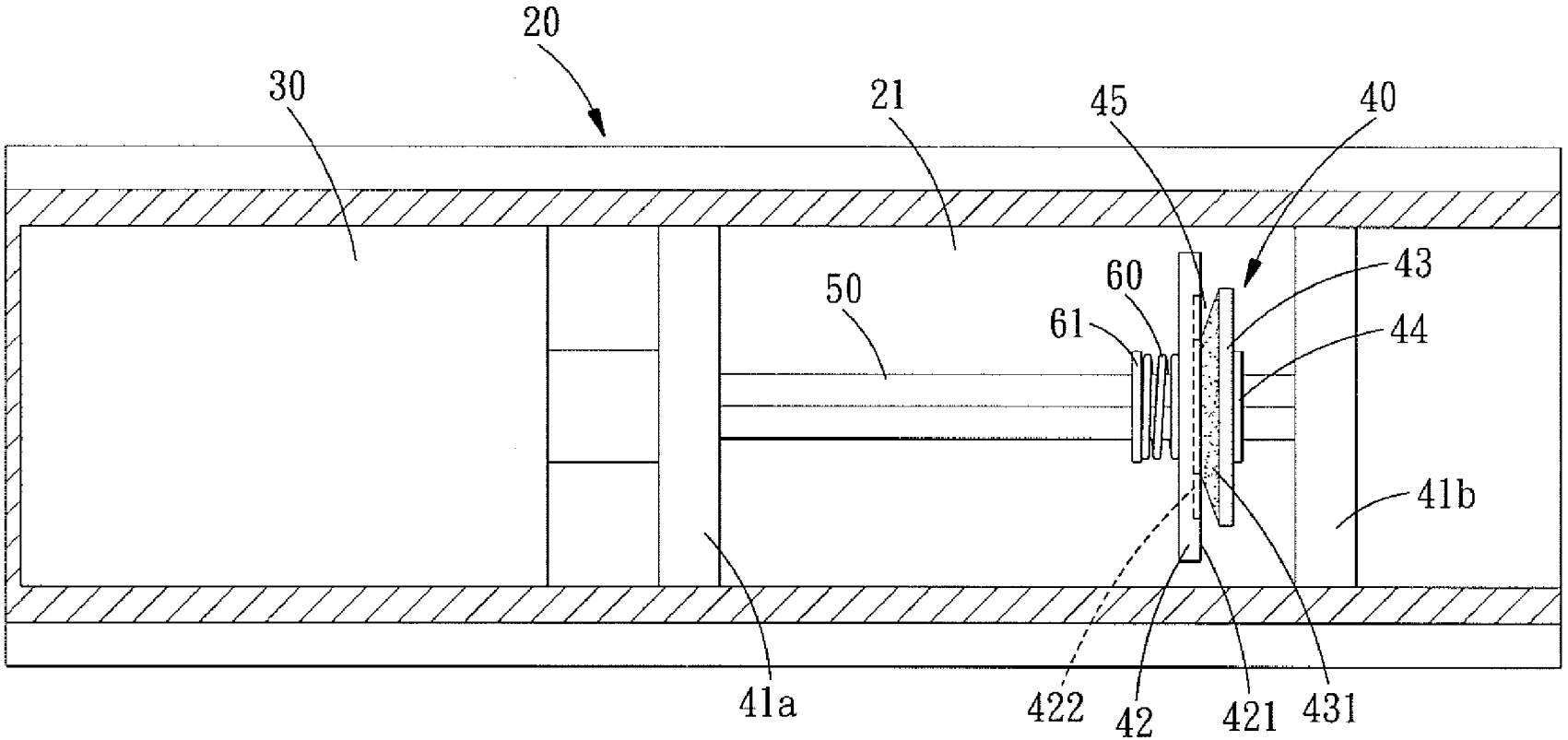
FIG. 7 is a transverse section view of the knife sharpener in accordance with the present invention.
Figure 8:
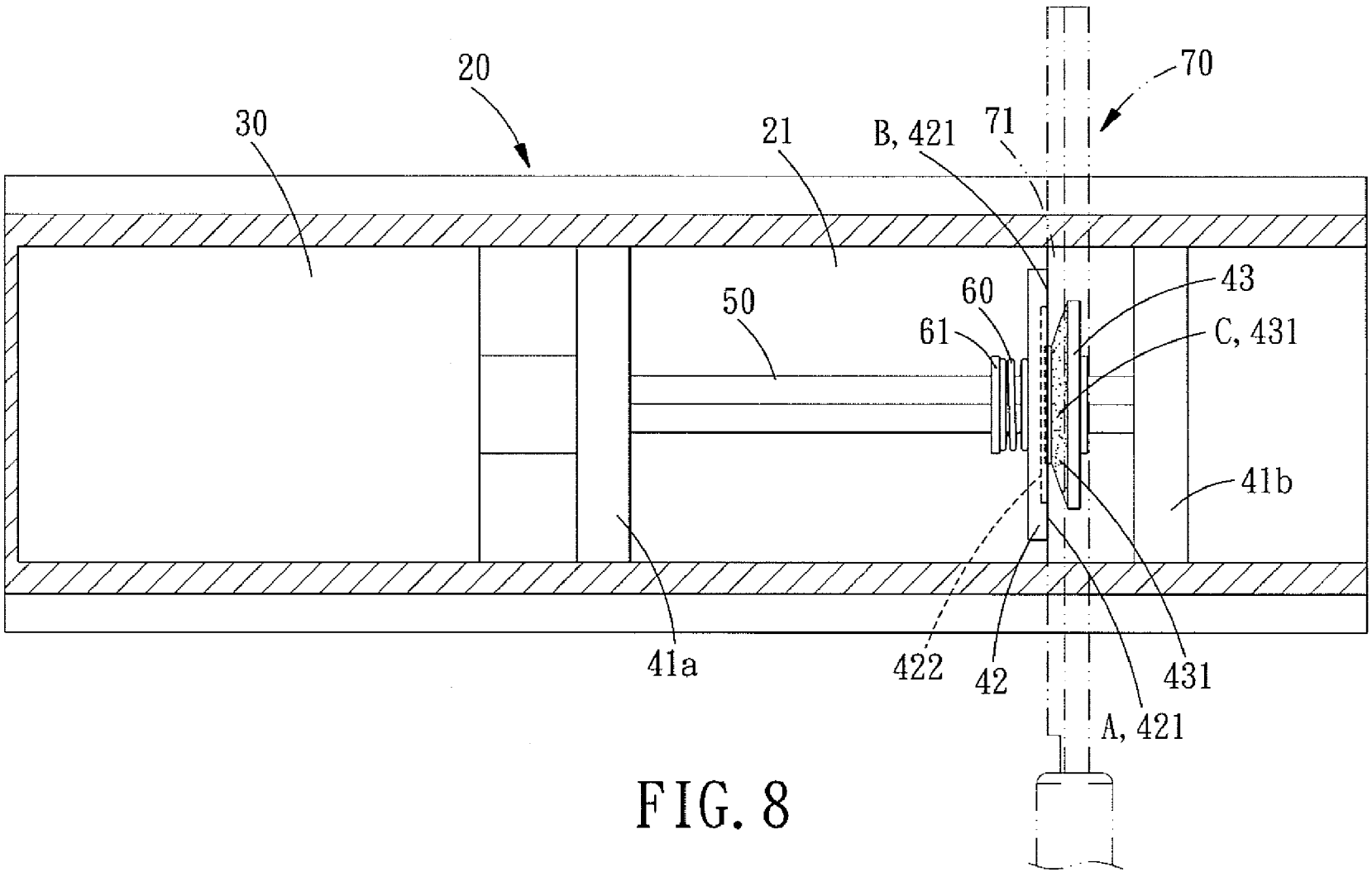
FIG. 8 is a transverse section view of showing that the knife sharpener in accordance with the present invention is grinding the cutting edge of a knife.
Figure 9:
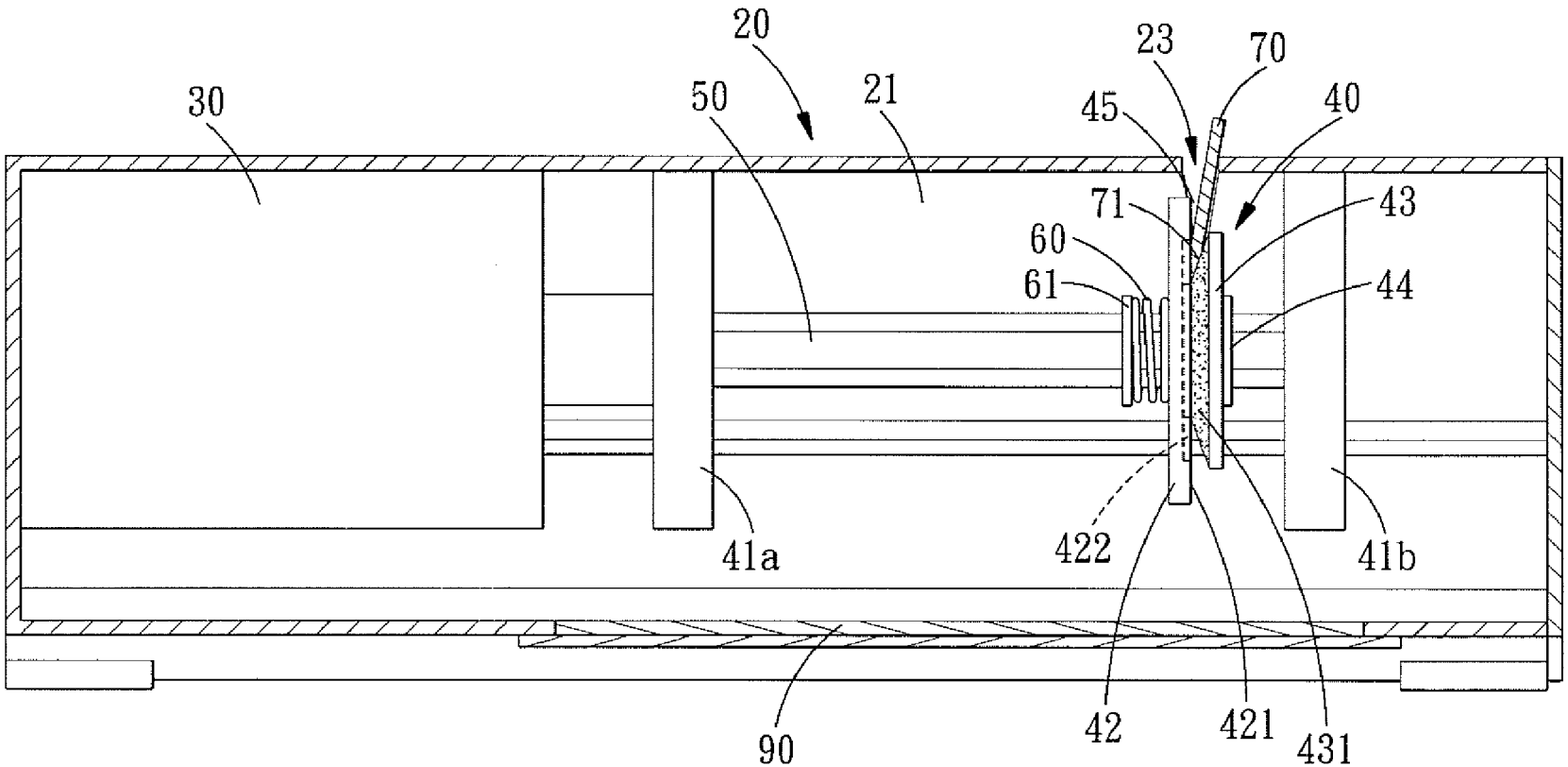
FIG. 9 is a longitudinal section view of showing that the knife sharpener in accordance with the present invention is grinding a knife with thin cutting edge.

Abovementioned is an illustration of the location and the structure of the respectively related subassemblies of the present invention. When the knife sharpener performs grinding operation, the grinding wheel assembly can simultaneously grind both cutting sides of the knife. In addition, the present invention can clamp the knife firmly through the three contacting points of the grinding disc, the grinding awl, and the cutting edge, so that the operation of knife grinding can be successfully performed. The following is the description of the operation state of the present invention:

Referring to FIGS. 8-9, the grinding wheel assembly 40 of the present invention performs the grinding operation by contacting the cutting edge 71 with the grinding disc 42 and the grinding awl 43. During the grinding process, the user can hold the knife 70 and place the cutting edge downwards into the slot 23 of the base 20, so that the cutting edge 71 contacts the high-speed running grinding disc 42 and the grinding awl 43, to perform grinding operation, as shown in FIG. 7.

Figure 6:
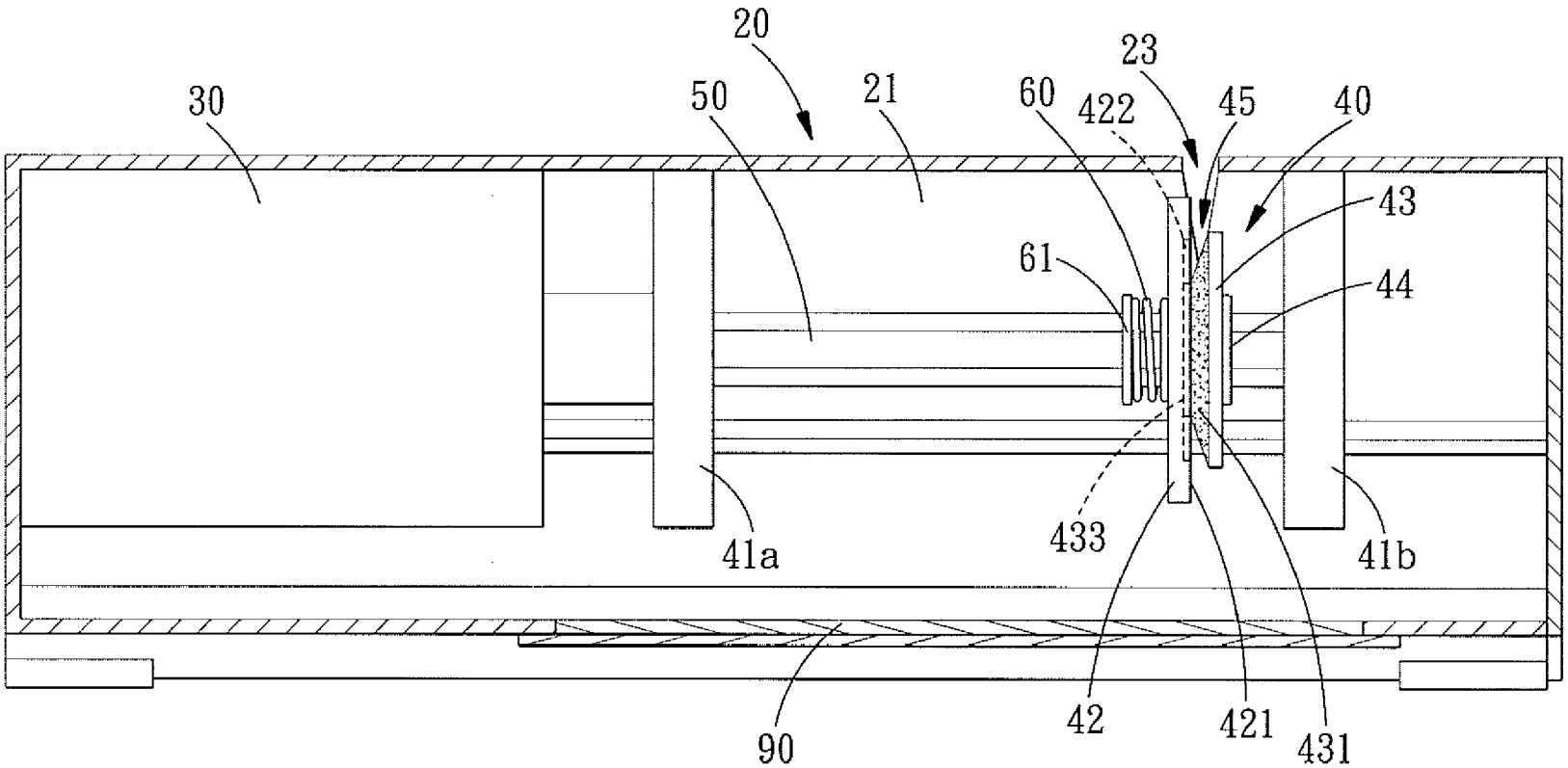
FIG. 6 is a longitudinal section view of the knife sharpener in accordance with the present invention.
Figure 10:
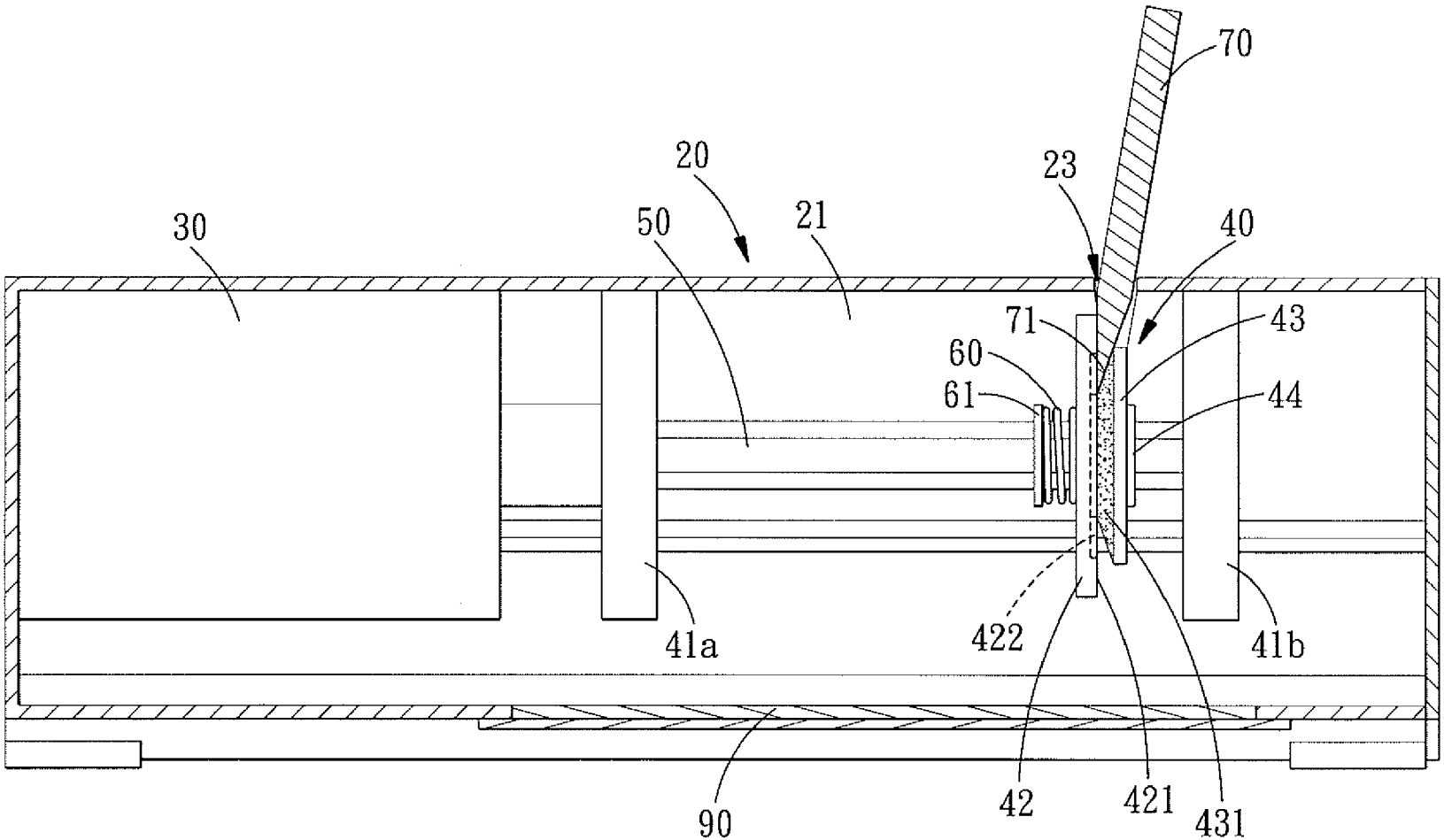
FIG. 10 is a longitudinal section view of showing that the knife sharpener in accordance with the present invention is grinding a knife with a thick cutting edge.

As shown in FIGS. 6-7, it is noted that the spring 60 is disposed at one side of the grinding wheel assembly 40 to push the grinding disc 42 toward the grinding awl 43, so that under normal conditions, the awl of the grinding awl 43 keeps contacting the grinding disc 42. When the knife 70 is placed in the working channel 45 between the edge of the grinding disc 42 and the grinding awl 43, the cutting edge 71 can push the grinding disc 42 slightly outward to enlarge the space between the grinding disc 42 and the grinding awl 43, so that cutting edges 71 with different thickness can adjust the space of the working channel 45 between the grinding disc 42 and the grinding awl 43. Namely, as shown in FIG. 9, a thin cutting edge 71 makes a narrow space, and as shown in FIG. 10, a thick cutting edge 71 makes a wide space. In addition, the awl of the tapered grinding surface 431 of the grinding awl 43 can keep the cutting edge 71 from overly moving downwards. In other words, the space of the working channel 45 can cooperate with the awl of the tapered grinding surface to deal with cutting edge 71 with different thickness, so that when cutting edge 71 of knives 70 with different thickness is to be ground, it can properly contact the grinding disc 42 and the grinding awl 43.

It is also noted that when the user grinds the knife 70, one side of the cutting edge 71 contacts the grinding surface 421 of the grinding disc 42 to perform grinding operation. In the present invention, the inner side of the grinding surface 421 is defined the receiving concave 422, as shown in FIG. 8. The grinding surface 421 contacts one side of the cutting edge 71 through two contacting points A and B to perform grinding operation, while the tapered grinding surface 431 of the grinding awl 43 contacts another side of the cutting edge 71 at the contacting point C to perform grinding operation. In other words, the grinding surface 421 and the tapered grinding surface 431 simultaneous contact two sides of the cutting edge 71 to perform grinding operation by way of three contacting points. As compared with traditional single-contacting point grinding operation, the prevent invention can improve stability between the knife 70 and the grinding wheel assembly 40.

Further, when grinding the knife, the user holds the knife 70 and moves it back and forth in a direction tangent to the running grinding wheel assembly 40. During the course of the user moving the knife 70 back and forth, the knife 70 is likely to shake in a non-linear fashion, but the present invention can prevent the knife 70 from excessively shaking and improve the stability of the operation by clamping the knife 70 with the grinding disc 42 and the grinding awl 43 at three contacting points.

Figure 11:
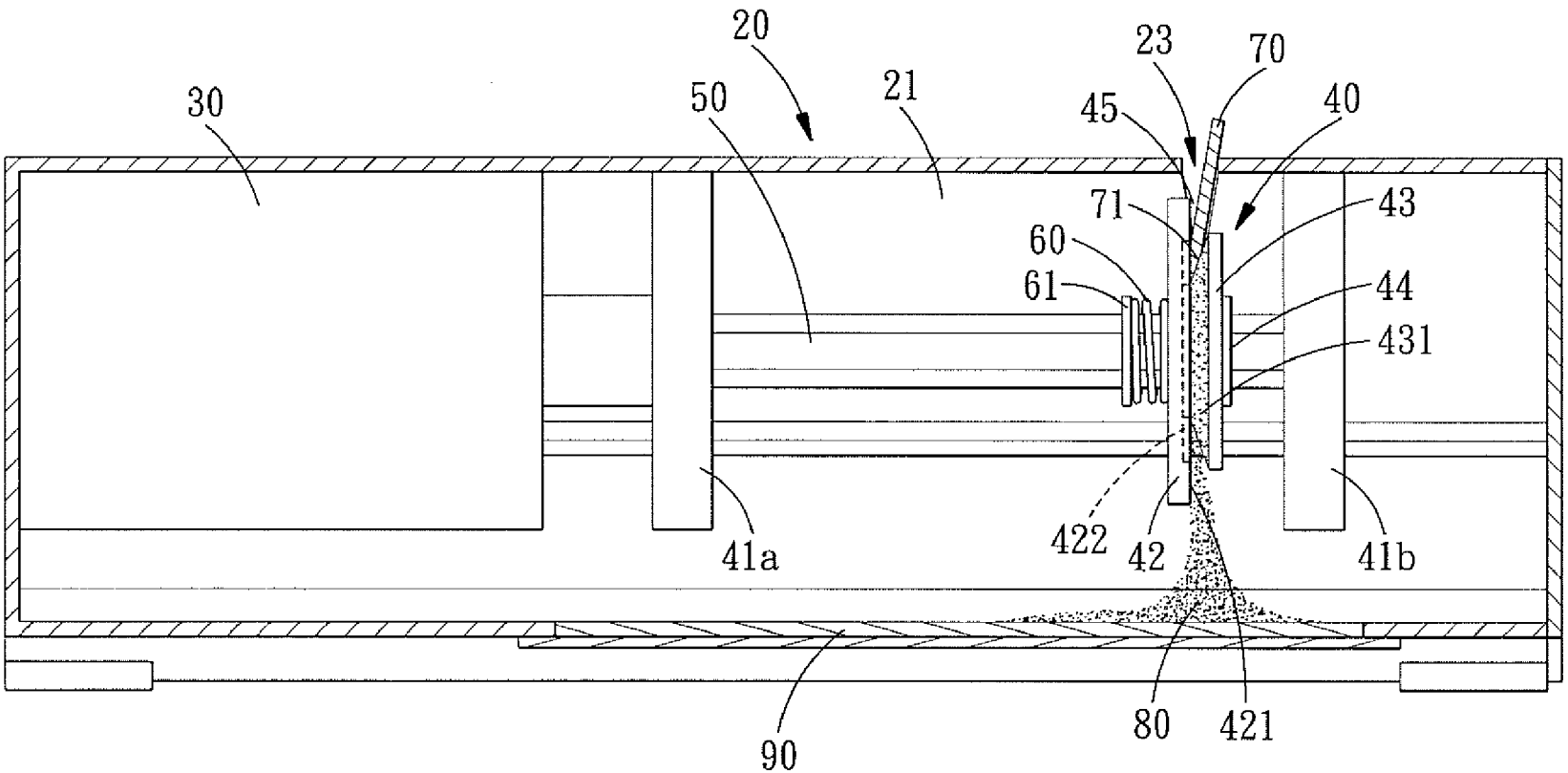
FIG. 11 is a perspective view in accordance with the present invention of showing that iron chips is produced during the course of knife sharpening.

In addition, in the inner side of the grinding surface 42 is defined the receiving concave 422. During the course of grinding, as shown in FIG. 11, iron chips 80 will be produced between the grinding surface 421 and the tapered grinding surface 431, and because of gravity, iron chips 80 will fall into the receiving concave 422 and will finally be collected on the bottom of base 20. During this course, the receiving concave 422 provides a space for temporarily receiving iron chips 80, so as to avoid iron chips 80 from being accumulated on the grinding surface 421 and the tapered grinding surface 431, which will influence the effect of grinding operation. Furthermore, at the bottom of the base 20 can be disposed a magnet 90 for attracting iron chips 80 and keeping iron chips 80 from flying in all directions, and the user can easily take out the magnet 90 to clean out iron chips 80.

Figure 12:
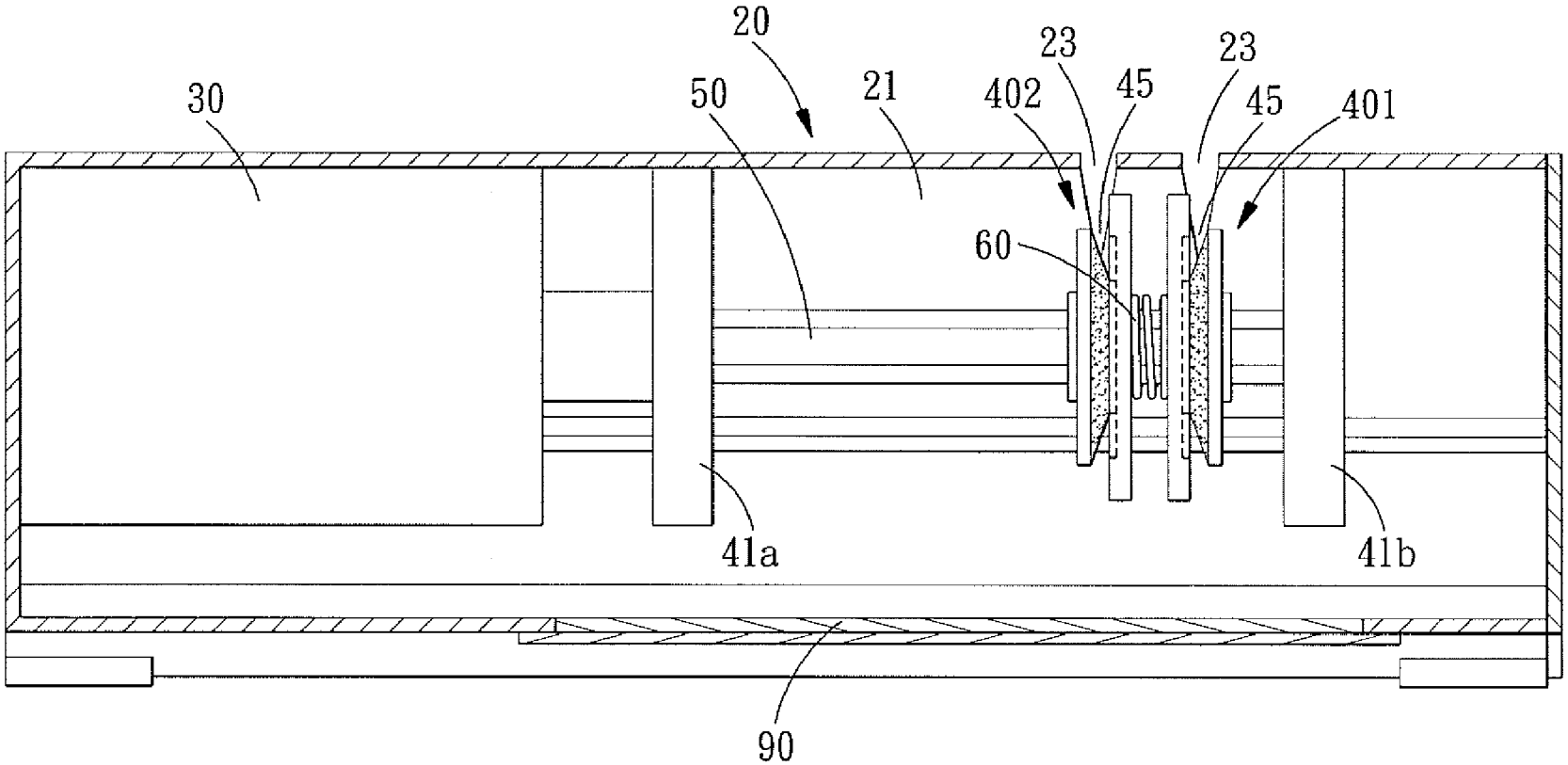
FIG. 12 is a perspective view of showing a knife sharpener with two grinding wheel assemblies in accordance with the present invention.

When using the knife sharpener, the user can assemble more than one grinding wheel assembly in the base 20. For example, as shown in FIG. 12, the user can assemble a coarse grinding wheel assembly 401 and a refined grinding wheel assembly 402. By such arrangements, when the user performs grinding, he can first do the primary grinding of a knife 70 through the coarse grinding wheel assembly 401, and then do the further grinding of the knife through the refined grinding wheel assembly 402, so that the grinding effect will be ideal and timesaving.

While we have shown and described various embodiments in accordance with the present invention, it is clear to those skilled in the art that further embodiments may be made without departing from the scope of the present invention.

What is claimed is:

1. A knife sharpener comprising:

a base defined with a receiving space for installation of grinding assemblies, a plurality of slots connecting with the receiving space being defined in a top surface of the base;

a motor serving as a power source of the knife sharpener being assembled at one side of the receiving space;

at least one grinding wheel assembly including two assembling members, a grinding disc and a grinding awl, each assembling member being provided with a bearing, the two assembling members being distantly disposed in the receiving space, so that the grinding disc is located between the two assembling members, the grinding disc has two surfaces, one of which is a grinding surface for grinding cutting edge, and a through hole formed in the middle of the grinding disc, the grinding awl being located between the two assembling members in such a manner that one surface of the grinding awl abuts against the grinding surface of the grinding disc, another surface of the grinding awl is rested against a fixing member, a surface of the grinding awl facing the grinding surface is a tapered grinding surface, which serves as another grinding surface of the knife sharper, a through hole formed in the middle of the grinding awl, the grinding disc and the edge of the grinding awl being located in a certain distance away from each other to form a working channel to be aligned with one of the slots;

a rotary shaft having one end fixed to a rotor of the motor, so that it is rotated by the motor, another end of the rotary shaft in turn passing through the bearing of the assembling member, the through hole of the grinding awl, the through hole of the grinding disc and the bearing of another assembling member, so that the two bearings and the grinding awl are fixed on the rotary shaft, that the grinding disc is moveable along the rotary shaft, and the rotary shaft is able to rotate the grinding disc and the grinding awl to grind the knife;

a spring is biased between the grinding disc and another fixing member, so as to keep the grinding surface of the grinding disc and the tapered grinding surface of the grinding awl close to each other under normal conditions, when the cutting edge of a knife is grinding in the working channel, the cutting edge can move the grinding disc to make the grinding surface and the tapered grinding surface move slightly in horizontal direction, while the tapered grinding surface can keep the cutting edge from overly moving downwards, so that the grinding surface and the tapered grinding surface can properly contact the cutting edge;

three restricting ribs are distantly mounted in an inner surface of the receiving space, while three engaging grooves are formed in an edge of the assembling members and three engaging grooves are formed on an outer surface of a housing of the motor to mate with the restricting ribs, so that the assembling members and the motor are stably assembled in the receiving space.

2. The knife sharpener as claimed in claim 1, wherein a receiving concave is defined in the grinding surface of the grinding disc, and iron chips produced during the course of grinding will fall into the receiving concave.

3. The knife sharpener as claimed in claim 1, wherein the rotary shaft is hexagonal-shaped, and the through hole of the grinding disc is a hexagonal hole accordingly, so that the rotary shaft is able to rotate the grinding disc and the grinding awl to grind the knife.

4. The knife sharpener as claimed in claim 1, wherein a magnet is defined in the base for attracting iron chips and preventing the iron chips from flying in all directions, and a user can easily take out the magnet to clean out the iron chips.

5. The knife sharpener as claimed in claim 1, wherein a coarse grinding wheel assembly and a refined grinding wheel assembly are assemble in the base, by such arrangements, when the user performs grinding operation, he can first do a primary grinding of the knife through the coarse grinding wheel assembly, and then do a refined grinding of the knife through the refined grinding wheel assembly.

* * * * *